US006464931B1

(12) United States Patent
Oota et al.

(10) Patent No.: US 6,464,931 B1
(45) Date of Patent: Oct. 15, 2002

(54) CASE FOR USE IN SINTERING PROCESS TO PRODUCE RARE-EARTH MAGNET, AND METHOD FOR PRODUCING RARE-EARTH MAGNET

(75) Inventors: Akiyasu Oota, Hyogo (JP); Tsuyoshi Wada, Wakayama (JP); Katsumi Okayama, Shiga (JP)

(73) Assignee: Sumitomo Special Metals Co., Ltd. (JP)

( * ) Notice: Subject to any disclaimer, the term of this patent is extended or adjusted under 35 U.S.C. 154(b) by 0 days.

(21) Appl. No.: 09/517,493

(22) Filed: Mar. 2, 2000

(30) Foreign Application Priority Data

Mar. 3, 1999 (JP) ..... 11-055247

(51) Int. Cl.[7] ..... B22F 3/12
(52) U.S. Cl. ..... 266/274; 419/38
(58) Field of Search ..... 419/38; 266/274

(56) References Cited

U.S. PATENT DOCUMENTS 5,281,250 A * 1/1994 Hamamura et al. ..... 75/255
5,533,930 A * 7/1996 Tsuzuki et al. ..... 432/120

FOREIGN PATENT DOCUMENTS

| | | |
|---|---|---|
| JP | 63-118031 | 5/1988 |
| JP | 63-192850 | 8/1988 |
| JP | 1-108353 | 4/1989 |
| JP | 7-207305 | 8/1995 |

* cited by examiner

*Primary Examiner*—Daniel J. Jenkins
(74) *Attorney, Agent, or Firm*—Nixon Peabody LLP; Jeffrey Costellia

(57) ABSTRACT

A case according to the present invention is used in a sintering process to produce a rare-earth magnet. The case includes: a body with an opening; a door for opening or closing the opening of the body; and supporting rods for horizontally sliding a sintering plate, on which green compacts of rare-earth magnetic alloy powder are placed. The supporting rods are secured inside the body. At least the body and the door are made of molybdenum.

16 Claims, 5 Drawing Sheets

CASE FOR USE IN SINTERING PROCESS TO PRODUCE RARE-EARTH MAGNET, AND METHOD FOR PRODUCING RARE-EARTH MAGNET

BACKGROUND OF THE INVENTION

1. Field of the Invention

The present invention relates to a case for use in a sintering process to produce a rare-earth magnet and to a method for producing a rare-earth magnet by a sintering process using the case.

2. Description of the Related Art

A rare-earth magnet is produced by pulverizing a magnetic alloy into powder, pressing or compacting the alloy powder in a magnetic field and then subjecting the pressed compact to a sintering process and an aging treatment. Two types of rare-earth magnets, namely, samarium-cobalt magnets and neodymium-iron-boron magnets, have found a broad variety of applications today. In this specification, a rare-earth magnet of the latter type will be referred to as an "R—T—(M)—B magnet", where R is a rare-earth element including Y, T is Fe or a Fe—Co compound, M is an additive and B is boron. The R—T—(M)—B magnet is often applied to many kinds of electronic devices, because the maximum energy product thereof is higher than any other kind of magnet and yet the cost thereof is relatively low. However, a rare-earth element such as neodymium is oxidized very easily, and therefore great care should be taken to minimize oxidation during the production process thereof.

In the prior art process, a green compact (or as-pressed compact) obtained by compacting R—Fe—B magnetic alloy powder is sintered within a furnace after the compact has been packed into a hermetically sealable container (sintering pack 100) such as that shown in FIG. 1. This is because the sintered compact would absorb too much impurity existing inside the furnace and be deformed if the compact was laid bare inside the furnace. The sintering pack 100 includes a body 101 of the size 250 mm.~300 mm.~50 mm., for example, and a cover 102. Inside the pack 100, multiple green compacts 80 are stacked one upon the other on a sintering plate that has been raised to a predetermined height by spacers (not shown). The sintering pack 100 may be made of SUS304, a type of stainless steel, for example, which is strongly resistant to elevated temperatures.

As shown in FIG. 2, multiple sintering packs 100 are stacked on a rack 201 with spacers 202 interposed therebetween. Then, the rack 201 is loaded into a sintering furnace in its entirety and subjected to a sintering process. After the sintering process is finished, the cover 102 is removed from each of these sintering packs 100 and the sintered compact is unloaded from the pack 100 and then transferred to another container for use in an aging treatment.

According to the conventional process, however, while the sintering pack 100, in which the green compacts 80 are packed, is being transported to the rack 201, the green compacts 80 might fall apart due to vibration or might have their edges chipped, thus adversely decreasing the production yield. A green compact for an R—Fe—B magnet, in particular, has usually been compacted with lower pressure compared to a ferrite magnet so that the particle orientation thereof in a magnetic field is improved. Thus, the strength of the green compact is extremely low, and great care should be taken in handling the compact.

Also, since the sintering pack 100 is provided with the cover 102, the green compacts 80 should be loaded and unloaded into/from the pack 100 manually. This is because it is difficult to load or unload them automatically. Thus, according to the conventional technique, productivity is hard to improve.

Moreover, although SUS304, the material for the sintering pack 100, is capable of withstanding an elevated temperature of 1000° C. or more, the mechanical strength of the material at that high temperature is not so high. Due to the effect of elevated temperature on the mechanical strength of the material, if the pack 100 is continuously used in the heat for a long time, then the cover 102 might be deformed thermally or a chemical reaction might be caused between Ni contained in SUS304 and Nd contained in the green compacts 80 to erode the container. That is to say, the material is not sufficiently durable. Additionally, its lack of dimensional precision means that SUS304 is inadequate to use with automated processes.

Another problem with the use of SUS304 for sintering cases is that its thermal conductivity is relatively low. To obtain a sufficiently high heat conduction through the walls of sintering pack made of SUS304, the walls of the pack must be of a thin construction, which undesirably decreases their strength. Increasing the thickness of the walls of the pack to increase their strength results in poor conduction of heat, which increases the amount of required time required for the sintering process.

SUMMARY OF THE INVENTION

An object of the present invention is providing a highly durable sintering case which exhibits excellent thermal conductivity and resistance to thermal deformation, and which will not react with rare earth elements.

Another object of the present invention is providing a sintering case, which is easily transportable and effectively applicable to an automated sintering furnace system and yet excels in shock resistance, mechanical strength and heat dissipation and absorption.

Still another object of the present invention is providing a method for producing a rare-earth magnet by performing sintering and associated processes using the inventive sintering case.

A case according to the present invention is used in a sintering process to produce a rare-earth magnet. The case includes: a body with an opening; a door for opening or closing the opening of the body; and supporting means for horizontally sliding a sintering plate, on which green compacts of rare-earth magnetic alloy powder are placed. The supporting means is secured inside the body. At least the body and the door are made of molybdenum.

In one embodiment of the present invention, the body consists of: a bottom plate; a pair of side plates connected to the bottom plate; and a top plate connected to the pair of side plates so as to face the bottom plate. The door is slidable vertically to the bottom plate by being guided along a pair of guide members. The guide members are provided at one end of the side plates. In this particular embodiment, the upper end of the door is preferably folded to come into contact with the upper surface of the top plate when the door is closed.

In another embodiment of the present invention, the case may further include a plurality of reinforcing members that are attached to the body to increase the strength of the body. Each said reinforcing member includes: a first part in contact with the body; and a second part protruding outward from the first part. In this particular embodiment, the reinforcing members are preferably made of molybdenum.

In still another embodiment, the supporting means preferably includes multiple rods that are supported by the pair of side plates, and each said rod is preferably made of molybdenum.

Another case according to the present invention is used in a sintering process to produce a rare-earth magnet and is made of molybdenum.

Still another case according to the present invention is used in a sintering process to produce a rare-earth magnet and is made of molybdenum containing at least one of: 0.01 to 2.0 percent by weight of La or an oxide thereof; and 0.01 to 1.0 percent by weight of Ce or an oxide thereof.

Yet another case according to the present invention is used in a sintering process to produce a rare-earth magnet and contains 0.1 percent by weight or less of carbon and at least one of: 0.01 to 1.0 percent by weight of Ti; 0.01 to 0.15 percent by weight of Zr; and 0.01 to 0.15 percent by weight of Hf. The balance of the case is made of molybdenum.

Yet another case according to the present invention is used in a sintering process to produce a rare-earth magnet. The case includes: a casing including platelike members; and means for supporting a sintering plate, on which green compacts of rare-earth magnetic alloy powder are placed. The supporting means is provided inside the casing. The case further includes a reinforcing member provided on an outer surface of the casing.

In one embodiment of the present invention, the platelike members are preferably made of a material mainly composed of molybdenum.

An inventive method for producing a rare-earth magnet includes the steps of: pressing rare-earth magnetic alloy powder into a green compact; and sintering the green compact to form a sintered body using the case of the present invention.

In one embodiment of the present invention, the method may further include the steps of: placing the green compact on the sintering plate; loading the sintering plate, on which the green compact has been placed, into the case through the opening of the case; and closing the opening of the case with the door.

In this particular embodiment, the method may further include the steps of: performing a burn-off process on the green compact inside the case before the step of sintering the green compact is carried out; and conducting an aging treatment on the sintered body inside the case after the step of sintering the green compact has been carried out.

More specifically, the method further includes the steps of: placing the case on transport means; getting the case moved by the transport means to a position where the burn-off process is performed; and getting the case moved by the transport means to a position where the sintering step is performed.

Specifically, the opening of the case is opened before the aging treatment is performed.

In another embodiment of the present invention, powder of a neodymium-iron-boron permanent magnet may be used as the rare-earth magnetic alloy powder.

In still another embodiment, a molybdenum plate may be used as the sintering plate.

More particularly, one end of the molybdenum plate is preferably bent.

In still another embodiment, a getter may be placed inside the case. In this particular embodiment, rare-earth magnetic alloy powder or a fragment of a green compact made of rare-earth magnetic alloy powder is preferably used as the getter.

DESCRIPTION OF THE PREFERRED EMBODIMENTS

Hereinafter, preferred embodiments of the present invention will be described with reference to the accompanying drawings.

Sintering Case

Figure 1:
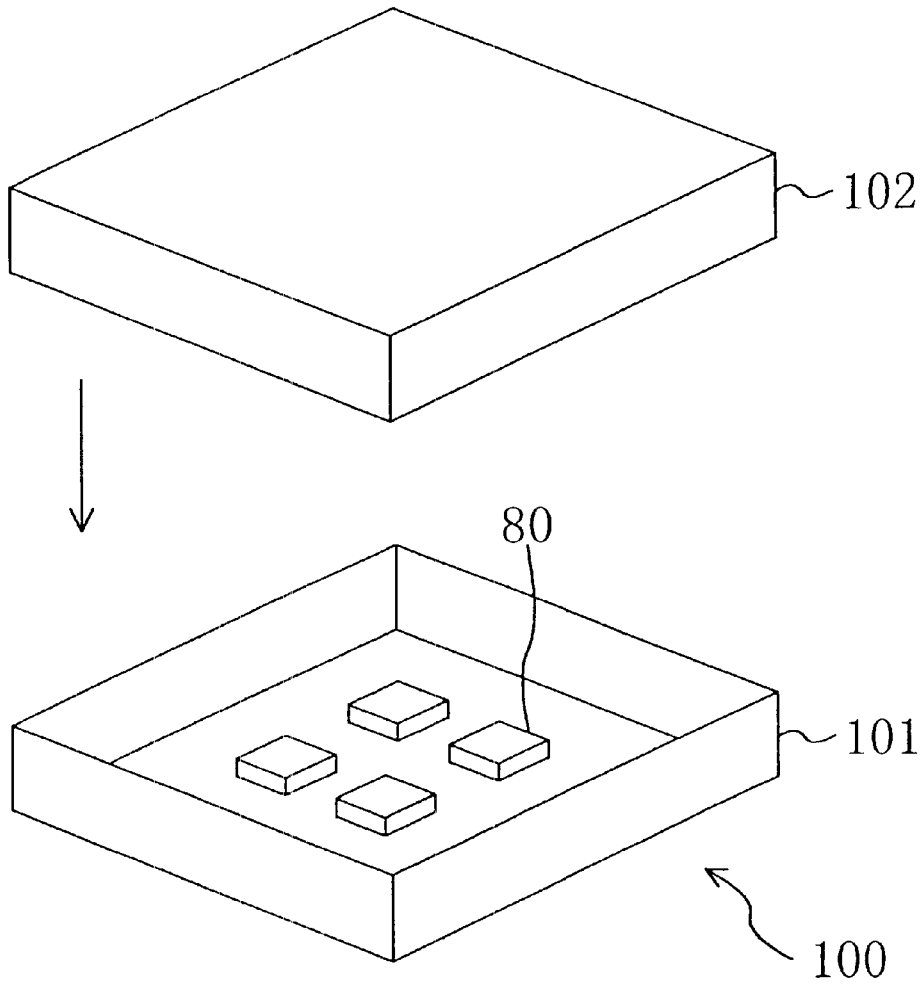
FIG. 1 is a perspective view illustrating a prior art hermetically sealable container (sintering pack), in which green compacts of R—T—(M)—B magnetic material powder to be subjected to a sintering process are packed.
Figure 2:
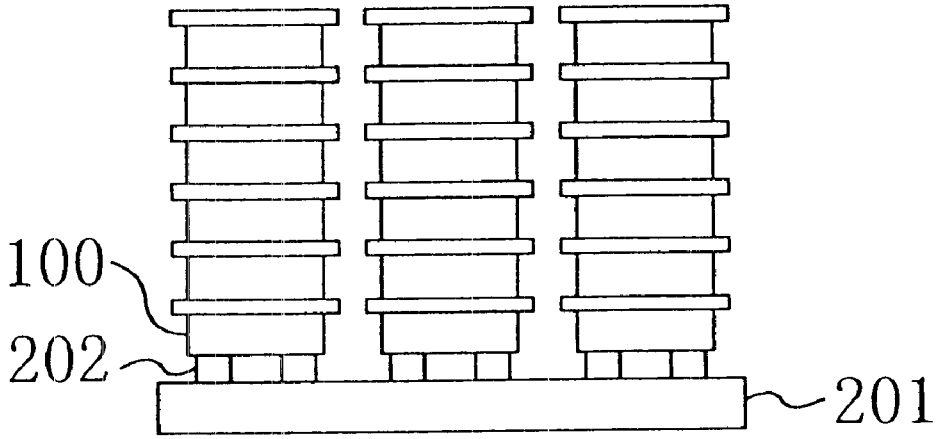
FIG. 2 is a side view illustrating a rack on which the conventional sintering packs are stacked one upon the other.
Figure 3:
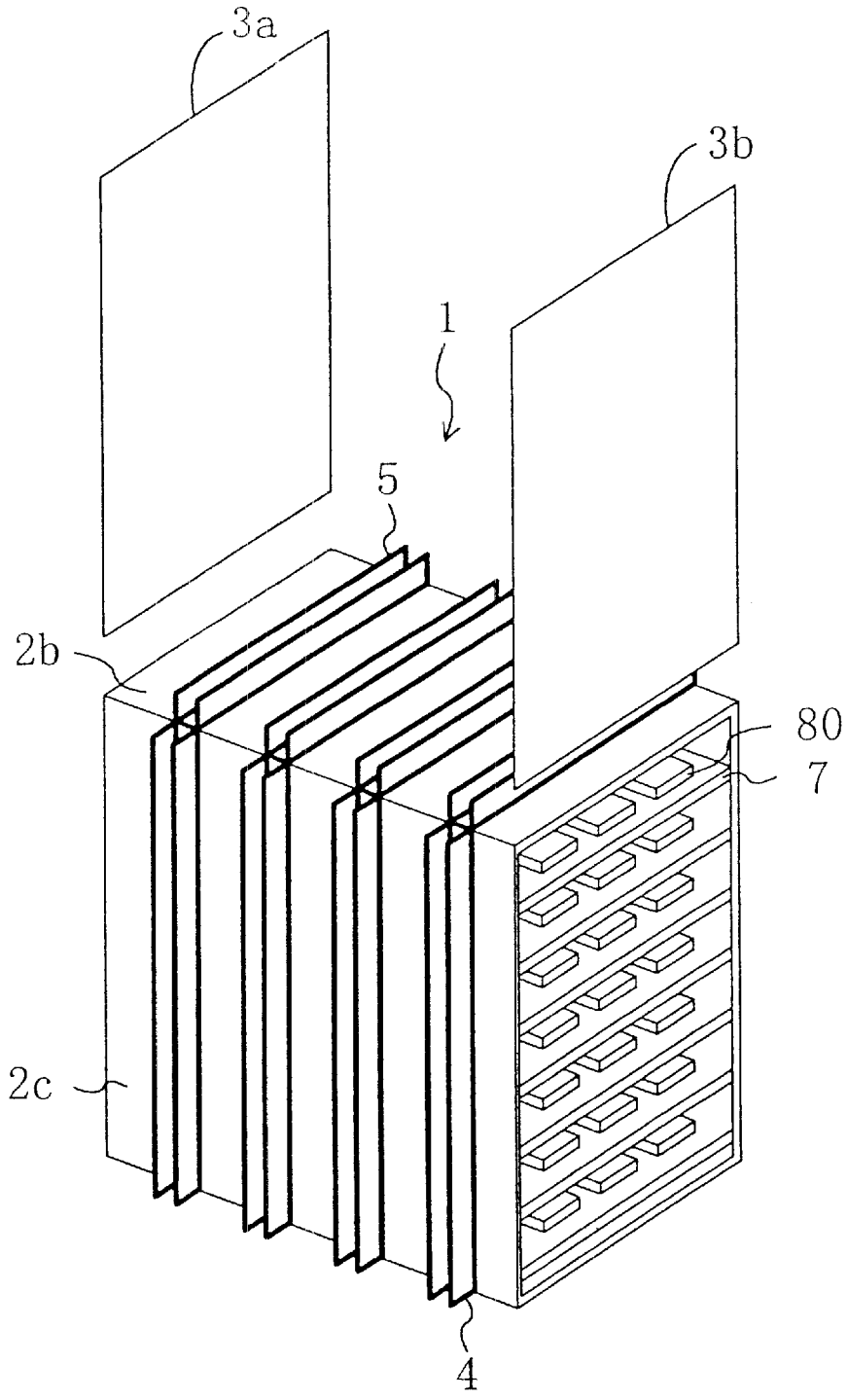
FIG. 3 is a perspective view schematically illustrating an embodiment of the inventive sintering case.
Figure 4A:
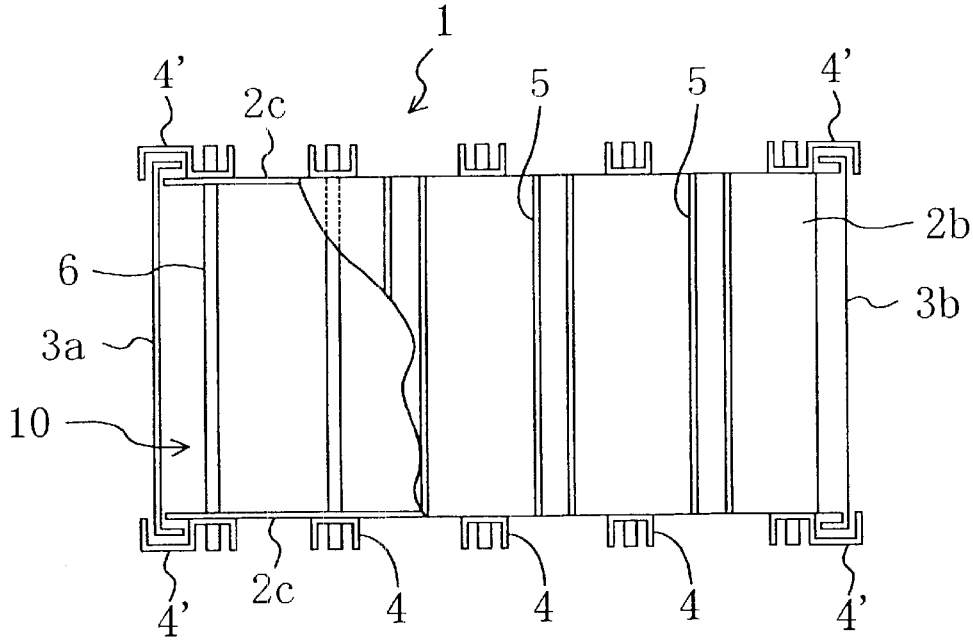
FIGS. 4A and 4B are respectively top view and side view illustrating another embodiment of the inventive sintering case.
Figure 4B:
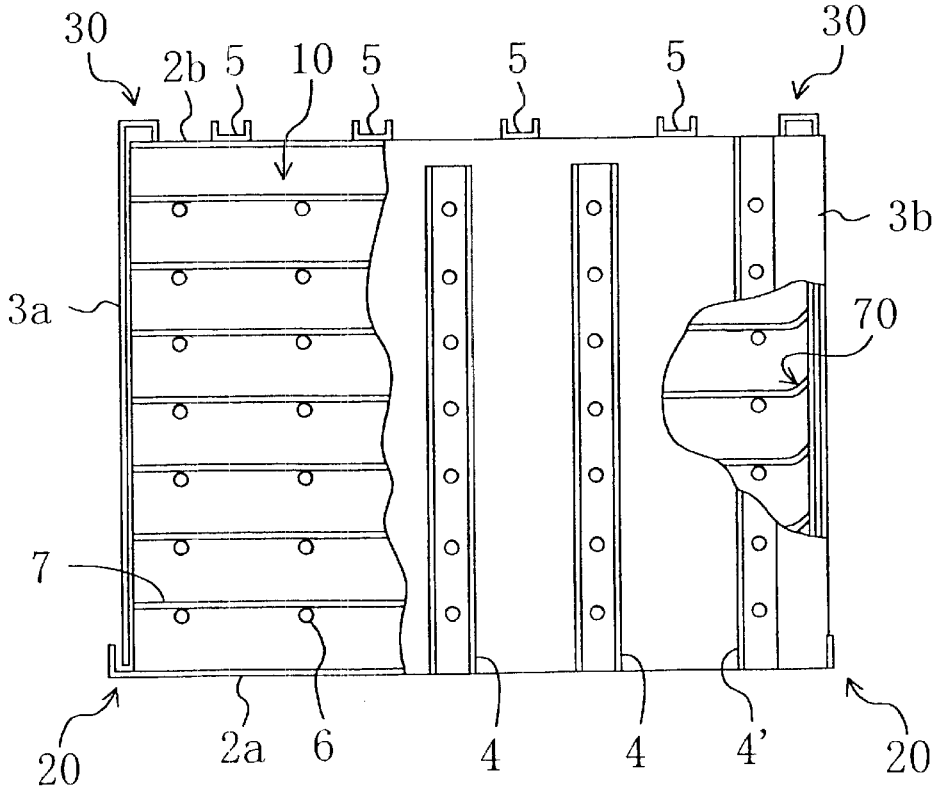

FIG. 3 is a perspective view schematically illustrating an embodiment of the inventive sintering case. FIGS. 4A and 4B respectively illustrate the top and side faces of another embodiment of the inventive sintering case. Hereinafter, a sintering case according to the present invention will be described with reference to FIGS. 4A and 4B.

The body frame 1 of the sintering case shown in FIGS. 3, 4A and 4B is made up of thin metal plates made of molybdenum with a thickness of about 1 to 3 mm. The body frame 1 is a boxlike container (or casing) with two mutually opposite sides opened, and consists of a bottom plate 2*a,* a top plate 2*b* and a pair of side plates 2*c*. The two openings of the body frame 1 are closed by two vertically slidable doors 3*a* and 3*b*. The size of the body frame 1 may be 350 mm. (width)~550 mm. (depth)~550 mm. (height), for example.

As shown in FIGS. 4A and 4B, multiple reinforcing channelshaped members 4 and 4' made of molybdenum are provided as members for enhancing the strength of the thin molybdenum side plates 2*c* of the body frame 1, thereby preventing the body frame 1 from being deformed. Each of the reinforcing channel-shaped members 4, 4' has a U-shaped cross section as shown in FIG. 4A. Thus, although the reinforcing channel-shaped member is thin, the channel-shaped member can exhibit sufficiently high mechanical strength and can also greatly increase the thermal conductivity (heat absorption and dissipation properties) of the body frame 1. This is particularly advantageous for controlling the temperature inside the sintering case that is sealed almost hermetically. That is to say, it takes a shorter time to heat or cool down the case to a desired temperature, thus improving the heat treatment processes such as sintering. The number and locations of the reinforcing channel-shaped members 4 and 4' are not limited to those illustrated in FIGS. 4A and 4B. Alternatively, the embodiment shown in FIG. 3 or any other embodiment may be adopted.

As shown in FIG. 4A, each of the reinforcing channel-shaped members 4' includes an inverted-U portion to guide the door 3*a* or 3*b* vertically and to increase the airtightness of the case when the doors 3*a* and 3*b* are closed. Correspondingly, both side edges of the door 3*a* or 3*b* are folded at right angles such that each of these folded edges is introduced into the space between the inverted-U portion of an associated reinforcing channel-shaped member 4' and an associated side plate 2*c*.

Each of these reinforcing channel-shaped members 4 and 4' can exhibit excellent heat dissipation and absorption properties so long as the channel-shaped member includes a first part in direct contact with the body frame 1 and at least one second fin-like part protruding outward from the first part. Accordingly, the channel-shaped member does not always have to have the U cross section, but may have, for example, an L-shaped cross section.

In the reinforcing channel-shaped members 4 and 4' used in this embodiment, the first part, in contact with the body frame 1, may be about 20 to about 40 mm wide, while the second part may protrude outward from the body frame 1 by about 5 to about 15 mm. These sizes may be appropriately selected depending on the desired amount of reinforcement and heat conduction.

If multiple sintering plates, on each of which a large number of green compacts are placed, are loaded into a single sintering case, then the total weight of the case, plates and compacts might reach as much as 50 to 150 kilograms. Thus, the sintering case should be reinforced sufficiently. For that purpose, the mechanical strength of the top plate 2*b* is enhanced according to this embodiment by attaching similar molybdenum reinforcing channel-shaped members 5 thereto.

By using the reinforcing members such as these, each of the building plates of the body frame 1 may be thinner (e.g., thinned to a thickness of 1.0 to 2.0 mm), thus further shortening the time to heat or cool down the case.

In addition, multiple molybdenum rods 6 (diameter: about 6 to about 14 mm) extending horizontally are provided for the inner space 10 of the body frame 1. Each of these rods 6 is supported by the pair of side plates 2*c* facing each other. These rods 6 are arranged in such a manner as to support horizontally the molybdenum sintering plates 7 (thickness: 0.5 to 3 mm) with the green compacts 80 placed thereon inside the body frame 1. The rods 6 are arranged at regular intervals, i.e., about 40 to 80 mm horizontally and about 30 to 80 mm vertically. Each end of the rods 6 is joined to the reinforcing channel-shaped member 4 by means of a nut.

In the illustrated embodiment, when the door 3*a* of the body frame 1 is opened, i.e., slid upward, the sintering plates 7 with the green compacts placed thereon can be loaded through the opening into the inner space 10. In this case, the sintering plates 7 are supposed to slide horizontally on the rods 8. However, since the plates 7 and rods 6 are both made of molybdenum with high self-lubricity, just a small frictional force is created therebetween and almost no abrasion is caused. Since the openings are provided on both sides, it is easier to load green compacts into the sintering case using an automated machine like a robot. In addition, there is no need to unload the sintered body from the sintering case before an aging treatment is performed.

In the illustrated embodiment, the sintering plates 7 are also made of molybdenum. Each of these sintering plates 7 is slightly bent upward at its rightmost end 70 (angle of inclination: about 20 to 40 degrees) as shown in FIG. 4B. This shape is adopted to insert the sintering plate 7 smoothly into the case by sliding it from the left to the right in FIG. 4B without making the end of the sintering plate 7 come into contact with the rods 6.

As shown in FIG. 4B, the upper end 30 of the doors 3*a* and 3*b* is also bent such that gas is less likely to flow into, or leak out of, the case through the gap between the top plate 2*b* and the doors 3*a* and 3*b* when the doors 3*a* and 3*b* are closed. The ends 20 of the bottom plate 2*a* that are adjacent to the doors 3*a* and 3*b* are also bent at right angles to eliminate the gap between the closed doors 3*a*, 3*b* and the bottom plate 2*a*. These bent members are used to increase the airtightness of the sintering case when the doors 3*a* and 3*b* are closed.

It should be noted that a tray made of carbon or a carbon composite (not shown) is preferably attached to the bottom plate 2*a* of the body frame 1 to make the case easily transportable within a sintering furnace. The tray may be secured to the body frame 1 via pins protruding out of the tray.

In the sintering case according to this embodiment, the body frame 1 is constructed of relatively thin molybdenum plates and the molybdenum reinforcing channel-shaped members 4, 4' and 5 are provided for its side and top plates 2*c* and 2*b*. Thus, the sintering case can exhibit high mechanical strength and yet the object to be processed using this sintering case can absorb or dissipate heat quickly. As a result, the time taken to perform the sintering process can be shortened considerably. In particular, since molybdenum, which not only excels in thermal conductivity but also does not react with Nd unlike Ni contained in stainless steel, is used according to the present invention, the durability of the case can be far superior to the stainless steel one.

Examples of imaginable metal materials other than molybdenum with excellent thermal conductivity include Cu and W. However, these materials are less preferable than molybdenum for the inventive sintering case. This is because Cu has insufficient strength and W is harder to shape. Fe is not preferable either, because Fe is likely to be deformed when heated or cooled down rapidly.

In view of these respects, the present invention has been described as being applied to a molybdenum sintering case. Alternatively, the sintering case may also be made of a material, which is mainly composed of molybdenum but contains other elements in small amounts. Specifically, the sintering case may also be made of molybdenum containing at least one of: 0.01 to 2.0 percent by weight of La or an oxide thereof; and 0.01 to 1.0 percent by weight of Ce or an oxide thereof. This alternative material is not only excellent in thermal conductivity, but also less likely to be hardened because molybdenum does not recrystallize at the sintering temperature of a rare-earth magnet (i.e., 1000 to 1100° C.). Accordingly, a sintering case made of this material has increased shock resistance and can be used repeatedly many times, because the case neither fractures nor cracks even when applied to an automated line. Also, by adding these impurities to molybdenum, processability is also improved compared to pure molybdenum.

As another alternative, the sintering case may also be made of a material containing: (a) 0.1 percent by weight or less of carbon; (b) at least one of 0.01 to 1.0 percent by weight of Ti, 0.01 to 0.15 percent by weight of Zr and 0.01 to 0.15 percent by weight of Hf; and (c) molybdenum as the balance. Similar effects to those attainable by molybdenum containing 0.01 to 2.0 percent by weight of La or an oxide thereof and/or 0.01 to 1.0 percent by weight of Ce or an oxide thereof can be attained in such a case.

Method for Producing Rare-earth Magnet

Hereinafter, a method for producing a magnet for a voice coil motor (VCM) will be described as an exemplary embodiment of the inventive method for producing a rare-earth magnet.

First, rare-earth magnetic alloy powder is prepared by known techniques. In this embodiment, cast flakes of an R—T—(M)—B alloy are obtained by a strip-casting technique to produce an R—T—(M)—B magnetic alloy. The strip-casting technique is disclosed in U.S. Pat. No. 5,383,978, for example. Specifically, an alloy, which contains 30 wt. % of Nd, 1.0 wt. % of B, 0.2 wt. % of Al and 0.9 wt. % of Co and the balance of which is °C. and inevitable impurities, is melted by a high frequency melting process to form a melt of the alloy. The molten alloy is kept at 1350° C. and then quenched by a single roll process to obtain a thin alloy with a thickness of 0.3 mm. The quenching process is performed under the conditions that the circumferential speed of the chill roll surface is about 1 m/sec., the cooling rate is about 500° C./sec. and sub-cooling degree is 200° C.

The quenched alloy is roughly pulverized by a hydrogen absorption process and then finely pulverized using a jet mill within a nitrogen gas environment. As a result, alloy powder with an average particle size of about 3.5 $\mu$m is obtained.

Then, 0.3 wt. % of a lubricant is added to the alloy powder obtained in this manner and mixed with the powder in a rocking mixer, thereby covering the surface of the alloy powder particles with the lubricant. A fatty acid ester diluted with a petroleum solvent is preferably used as the lubricant. In this embodiment, methyl caproate is preferably used the fatty acid ester and isoparaffin is preferably used as the petroleum solvent. The weight ratio of methyl caproate to isoparaffin may be 1:9, for example.

Next, the alloy powder is compacted using a press to form a green compact in a predetermined shape (size: 30 mm.~40 mm.~80 mm.). The green density of the as-pressed compact may be set at about 4.3 g/cm$^3$, for example. After the green compact has been formed by the press, the compact is placed onto the sintering plate 7. In this case, multiple green compacts may be placed on a single sintering plate 7. The door 3*a* is slid upward to open the opening of the body 1 and several sintering plates 7, on each of which the green compacts are placed, are loaded into the sintering case. This loading operation is preferably performed automatically using a robot. Thereafter, the door 3*a* is closed to create a substantially airtight condition within the sintering case. In this case, an inert gas is preferably supplied into the sintering case to minimize the exposure of the green compacts to the air. The space inside the sintering case is not airtight completely, and therefore, the air flows into the sintering case little by little with time. Even so, the oxidation of the green compacts can be substantially suppressed compared to a situation where the green compacts are in direct contact with the air.

Also, rare-earth magnetic alloy powder or a fragment of a green compact made of rare-earth magnetic alloy powder is preferably placed as a getter inside the sintering case, e.g., on the sintering plates. Specifically, the getter should be placed near a region through which a gas expectedly flows into or leaks out of the case, e.g., near the gap between the body frame 1 and the door 3*a* or 3*b* of the sintering case. The getter does not have to be the rare-earth magnetic alloy powder or a fragment thereof so long as the getter can trap a gas that easily reacts with the magnetic material powder contained in the green compacts. However, the fragment or powder of the as-pressed green of the rare-earth magnet is preferred because the fragment or powder not only shows high reactivity against a gas, which easily reacts with the magnetic material powder contained in the green compacts, but also is easily available.

Figure 5:
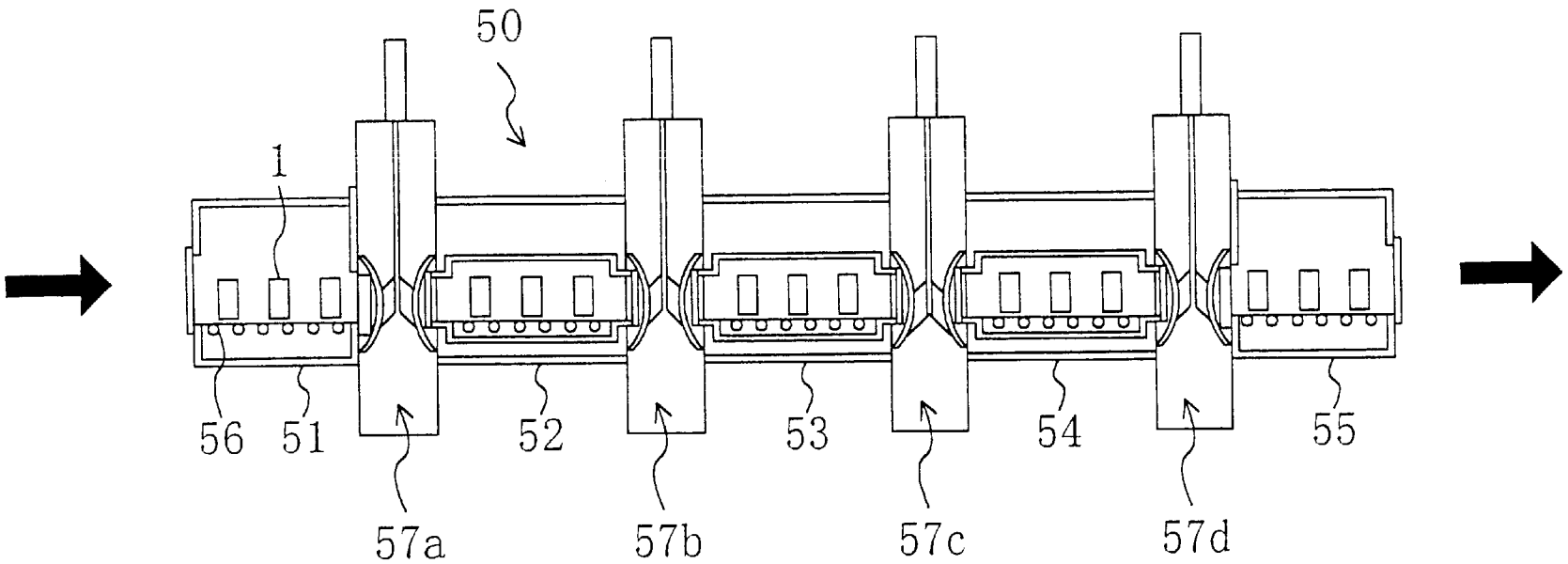
FIG. 5 schematically illustrates a sintering furnace system suitably applicable to an inventive method for producing a rare-earth magnet.

The sintering case, in which a large number of green compacts are loaded, is mounted on an automatic transporter, for example, which transports the case to a sintering furnace system 50 shown in FIG. 5. The sintering furnace system 50 includes a preparation chamber 51, a burn-off chamber 52, a first sintering chamber 53, a second sintering chamber 54 and a cooling chamber 55. Adjacent chambers are linked together via a coupling 57*a*, 57*b*, 57*c* or 57*d*. These couplings 57*a* through 57*d* are so constructed as to transport the sintering case through the processing chambers without exposing the case to the air. In this sintering furnace system 50, the sintering case mounted on a tray (not shown) is carried by rollers 56 and stops at each of these chambers to be subjected to each required processing for a predetermined time. Each process is carried out in accordance with a recipe that has been appropriately selected from a plurality of preset recipes. To improve the mass productivity, all the processes performed in these processing chambers are preferably under the systematic computerized control of a CPU, for example. In this embodiment, optimum known processes may be performed depending on the type of a rare-earth magnet to be produced. Hereinafter, the respective processes will be briefly described.

First, at least one sintering case is loaded into the preparation chamber 51 located at the entrance of the sintering furnace system 50 and the preparation chamber 51 is closed airtight and evacuated until the ambient pressure reaches about 2 Pa to prevent oxidation. Then, the sintering case is transported to the burn-off chamber 52, where a burn-off process (i.e., a lubricant removal process) is carried out at a temperature of 250 to 600° C. and at a pressure of 2 Pa for 3 to 6 hours. The burn-off process is performed to volatilize the lubricant covering the surface of the magnetic powder before the sintering process is carried out. The lubricant has been mixed with the magnetic powder prior to the press compaction to improve the orientation of the magnetic powder during the press compaction, and exists among the particles of the magnetic powder. During the burn-off process, various types of gases are generated from the as-pressed compacts, but the getter can also function as an absorbent (or trap) of these gases.

After the burn-off process is finished, the sintering case is transported to the sintering chamber 53 or 54, where the case is subjected to a sintering process at 1000 to 1100° C. for 2 to 5 hours. Thereafter, the sintering case is transported to the cooling chamber 55 and cooled down until the temperature of the sintering case reaches about room temperature.

Next, the sintering case is unloaded from the sintering furnace system 50, the doors 3*a* and 3*b* thereof are slid upward and removed completely and then the sintering case is inserted into an aging treatment furnace, where an ordinary aging treatment is performed on the case. The doors 3*a* and 3*b* may be opened or closed either manually or automatically. The aging treatment may be performed for about 3 to 7 hours within an ambient gas at a pressure of about 2 Pa and at a temperature of 400 to 600° C. According to this embodiment, there is no need to unload the green compacts from the sintering case when the aging treatment is performed. Thus, compared to the conventional process, the number of process steps and/or working time can be reduced.

In an actual process, multiple sintering cases are loaded into the processing chambers at a time and subjected to the same process in each of these chambers. A great number, e.g., 200 to 800, of green compacts can be packed within a single sintering case. In addition, respective process steps can be efficiently performed in parallel. For example, while the sintering process is being carried out in the sintering chamber, sintering cases that have already been subjected to the sintering process can be cooled down in the cooling chamber. In the meantime, other sintering cases that will soon be subjected to the sintering process can also be processed in the burn-off chamber.

In general, it takes a relatively long time to perform a sintering process. Thus, a plurality of sintering chambers are preferably provided as shown in FIG. 5 such that a great number of sintering cases can be subjected to the sintering process at the same time. In that case, sintering processes may be performed in respective sintering chambers under mutually different conditions.

According to this embodiment, the case can be. thinner than the conventional one, not only because the case is made of molybdenum with excellent thermal conductivity but also because the case is provided with the reinforcing members with the U cross section. Thus, even if the sintering process is carried out in completely the same way as the prior art process, the processing time can be shortened by as much as about 10%. In addition, the molybdenum sintering case is hard to deform thermally and has such a construction as allowing the green compacts to be loaded and unloaded into/from the case easily. Thus, the molybdenum case is suitably applicable to an automated procedure and contributes to reduction in number of required process steps and/or working time and improvement in throughput of the production process. Furthermore, since the green compacts are much less likely to fall apart during transportation, the production yield can be improved by 1%.

The inventive method for producing a rare-earth magnet is applicable not just to the magnet with the above composition, but also to various R—T—(M)—B magnets in general. Such magnets are disclosed in U.S. Pat. No. 4,770,723. For example, according to the present invention, a material containing, as the rare-earth element R, at least one element selected from the group consisting of Y, La, Ca, Pr, Nd, Sm, Gd, Tb, Dy, Ho, Er, Tm and Lu may be used. Also, to attain sufficient magnetization, at least one of Pr and Nd should account for 50 atomic percent or more of the rare-earth element R. If the rare-earth element R accounts for 10 atomic percent or less of the magnetic material, then the coercivity of the resultant magnet will decrease because α-Fe phases are deposited. Conversely, if the rare-earth element R exceeds 20 atomic percent, then secondary R-rich phases are unintentionally deposited in addition to the desired tetragonal $Nd_2Fe_{14}B$ compounds, resulting in decrease of magnetization. Thus, the rare-earth element R preferably accounts for 10 to 20 atomic percent of the material.

T is a transition metal element containing Fe or Fe and Co. If T accounts for less than 67 atomic percent of the material, then the magnetic properties deteriorate because the secondary phases with low coercivity and low magnetization are formed. Nevertheless, if T exceeds 85 atomic percent of the material, then α-Fe phases are grown to decrease the coercivity and the shape of the demagnetization curve is degraded. Thus, the content of T is preferably in the range from 67 to 85 atomic percent of the material. Although T may consist of Fe alone, T preferably contains Co, because Curie temperature is increased and the temperature dependency of the magnet improves in such a case. Also, Fe preferably accounts for 50 atomic percent or more of T. This is because if Fe accounts for less than 50 atomic percent of T, the saturation magnetization itself of the $Nd_2Fe_{14}B$ compound decreases.

B is indispensable to form the stable tetragonal $Nd_2Fe_{14}B$ crystal structure. If B added is less than 4 atomic percent of the material, then $R_2T_{17}$ phases are formed and therefore coercivity decreases and the shape of the demagnetization curve is seriously deteriorated. However, if B added exceeds 10 atomic percent of the material, then secondary phases with weak magnetization are grown unintentionally. Thus, the content of B is preferably in the range from 4 to 10 atomic percent of the material.

To improve the magnetic anisotropy of the powder, at least one element selected from the group consisting of Al, Ti, Cu, V, Cr, Ni, Ga, Zr, Nb, Mo, In, Sn, Hf, Ta and W may be mixed as an additive. But the magnetic material powder may include no additive at all. An additive mixed preferably accounts for 10 atomic percent of the material or less. This is because if the additive exceeds 10 atomic percent of the material, then secondary phases, not ferromagnetic phases, are deposited to decrease the magnetization. No additive element M is needed to obtain magnetically isotropic powder. However, Al, Cu or Ga may be added to improve the intrinsic coercivity.

According to the present invention, even if a sintering process is carried out in the same way as the prior art process, the processing time still can be shortened considerably. In addition, the inventive case has such a construction as allowing the green compacts to be loaded and unloaded into/from the case easily. Thus, the inventive case is suitably applicable to an automated procedure and contributes to reduction in number of required process steps or working time and significant improvement in throughput of the production process. Furthermore, since the green compacts are much less likely to fall apart during transportation, the production yield can be improved.

These effects of the present invention are also attainable even if the present invention is applied to producing a sintered magnet other than the R—T—(M)—B magnet.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A case for use in a sintering process to produce a rare-earth magnet, the case comprising:

a body with an opening; said body including a bottom plate; and a pair of side plates connected to the bottom plate, a door for opening or closing the opening of the body; and supporting means for supporting green compacts of rare-earth magnetic alloy powder, the supporting means being secured to and supported by tbe pair of side plates.

2. The case of claim 1, wherein the body includes: a top plate connected to the pair of side plates so as to face the bottom plate, and wherein the door is slidable vertically to the bottom plate by being guided along a pair of guide members, the guide members being provided at one end of the side plates.

3. The case of claim 2, wherein the upper end of the door is folded to come into contact with the upper surface of the top plate when the opening of the body is closed with the door.

4. A case for use in a sintering process to produce a rare-earth magnet the case comprising:

a casing including platelike members, said platelike members including side plates; and means for supporting a sintering plate, on which green compacts of rare-earth magnetic alloy powder are placed, the supporting means being secured to and supported by said side plates and extending horizontally.

5. The case of claim 4, wherein the platelike members are made of a material mainly composed of molybdenum.

6. A method for producing a rare-earth magnet, comprising the steps of:

pressing rare-earth magnetic alloy powder into a green compact; and sintering the green compact to form a sintered body using the case as recited in any one of claims 1 to 3.

7. A method for producing a rare-earth magnet, comprising the steps of:

pressing rare-earth magnetic alloy powder into a green compact; and sintering the green compact to form a sintered body using the case as recited in claim 4.

8. The method of claim 6, further comprising the steps of:

placing the green compact on a sintering plate;

loading the sintering plate, on which the green compact has been placed, into the case through the opening of the case; and closing the opening of the case with the door.

9. The method of claim 8, further comprising the steps of:

performing a burn-off process on the green compact inside the case before the step of sintering the green compact is carried out; and conducting an aging treatment on the sintered body inside the case after the step of sintering the green compact has been carried out.

10. The method of claim 9, further comprising the steps of:

placing the case on transport means;

getting the case moved by the transport means to a position where the burn-off process is performed; and getting the case moved by the means to a position where the sintering step is performed.

11. The method of claim 10, wherein opening of the case is before the aging treatment is performed.

12. The method of claim 6, wherein powder of a neodymium-iron-boron permanent magnet is used as the rare-earth magnetic alloy powder.

13. The method of claim 8, wherein a molybdenum plate is used as the sintering plate.

14. The method of claim 13, wherein one end of the molybdenum plate is bent.

15. The case of claim 2, wherein each of the body plates has a thickness of 1.0 to 2.0 mm.

16. The case of claim 4, wherein each plate-like member has a thickness of 1.0 to 2.0 mm.

* * * * *